US005367975A

United States Patent [19]

Hamilton et al.

[11] Patent Number: 5,367,975

[45] Date of Patent: Nov. 29, 1994

[54] KAYAK COCKPIT COVER WITH RETENTION EDGE

[76] Inventors: Don A. Hamilton, 108 Buena Vista Dr., Easley, S.C. 29640; William E. Masters, 100 Bentcreek Ct., Easley, S.C. 29642

[21] Appl. No.: 990,090

[22] Filed: Dec. 14, 1992

[51] Int. Cl.[5] ..... B63B 19/00

[52] U.S. Cl. ..... 114/347; 114/361; 277/212 FB

[58] Field of Search ..... 114/347, 345, 351, 361, 114/364, 346, 201 R, 201 A, 203; 24/17 AP, 16 PB, 30.5 P; 135/88, 119; 150/166, 901; 220/200, 213, 232, 305, 306, 315, 320, 353, 356; 215/272, 317, 321, 341, 342, 280, 282, 287, 293; 277/212 R, 212 C, 212 FB, 237 A, DIG. 4, 181

[56] References Cited

U.S. PATENT DOCUMENTS

| | | | |
|---|---|---|---|
| 1,284,968 | 11/1918 | Anderson | 114/361 |
| 2,691,977 | 10/1954 | Wallin | 128/30 |
| 3,486,788 | 12/1969 | Benton | 296/120 |
| 3,532,244 | 10/1970 | Yates, Jr. | 215/41 |
| 3,698,409 | 10/1972 | Koontz et al. | 135/6 |
| 4,583,480 | 4/1986 | Hamilton et al. | 114/347 |
| 5,145,191 | 9/1992 | Stewart | 277/212 |
| 5,215,032 | 6/1993 | Ellis | 114/361 |

FOREIGN PATENT DOCUMENTS

| | | | |
|---|---|---|---|
| 424910 | 2/1926 | Germany | 114/347 |
| 1277696 | 9/1968 | Germany | 114/347 |

*Primary Examiner*—Robert J. Oberleitner
*Assistant Examiner*—Clifford T. Bartz
*Attorney, Agent, or Firm*—Cort Flint

[57] ABSTRACT

A spray skirt (A) is disclosed for covering the cockpit opening (14) of a kayak (10). The spray skirt includes a fabric cover (24) for spanning the opening which includes an elastic band (B) secured around the perimeter of the cover for retaining the spray skirt about a rim (16) of the opening. The retaining band includes outer and inner elastic bands (30, 32) joined by a compressible bulbous retention element (34, 40). The inner band 32 is of sufficient width to prevent contact of the interior fabric (**24*b*) of the cover from being abraded by lip contact. The preformed outer band (30) includes a first outer band (30*a*) extending from the bulbous element upwardly and outwardly terminating at a bend (35), and a second outer band (30*b*) extending from the bend upwardly and inwardly. The first outer band fits under the rim and the second outer band extends over rim and substantially inward over the exterior cover surface to protect the exterior cover surface from abrasion against the rim when hit by the paddle and the like. In a preferred embodiment of the invention, the bulbous element 40 is utilized and has a wall thickness greater than the wall thickness of outer band 42.** Preferably, the wall of thickness of the bulbous element is about twice as thick as the wall thickness of the outer band.

16 Claims, 3 Drawing Sheets

KAYAK COCKPIT COVER WITH RETENTION EDGE

BACKGROUND OF THE INVENTION

The invention relates to a cockpit cover for covering the seat opening of a kayak and the like boat which fits about the waist of the boater and over a rim about the cockpit to seal the cockpit opening against the entry of water. In particular, the invention relates to such a cockpit cover wherein the cover is protected against abrading around the cockpit rim. Kayaks are susceptible to being turned over in use and it is desirable to be able to return the kayak to an upright position while the boater remains seated. When used under white water conditions entry of water into the hull interior through the cockpit opening is high likely. For the above reasons, a cover which will fit about the boater and the cockpit opening to seal effectively against the entry of water is a problem to which considerable attention need be given. In case of emergency, the boater must be able to remove the cover quickly without failure so that he may escape the kayak or boat.

Heretofore, covers have been proposed and utilized which include a cover made of foam rubber material for covering the cockpit having a fitted opening which fits about the waist of a boater. The covers have utilized an elastic band stretched around the circumference of the cockpit and fitted underneath the lip of the rim of the cockpit. Once seated in the cockpit, the boater stretches the cover about the rim of the opening and secures the rubber band under the lip of the rim. However, the band is attached to the exterior surface of the cover, leaving the interior surface of the cover unprotected. The problem occurs that the interior surface of the cover is fitted against the rim lip and is highly susceptible to abrasion as the boater's body twists and turns in use pulling the cover against the lip of the boat abrading the cover. The rubber band which is typically flat also requires a good bit of effort to be pulled out from under the rim lip around the perimeter of the cockpit opening. Other methods such as drawstrings also leave the cover exposed for abrading and require considerable effort in fastening and unfastening the cockpit cover. Elastic shock cords have also been utilized as a drawstring, which also are required to be pulled and tied for fitting about the rim. U.S. Pat. No. 4,583,480 discloses a cockpit cover having an elastic outer band which terminates in a bulbous element that rolls under a lip of the cockpit rim for secure attachment. However, the cockpit cover is still susceptible to abrasion on the outside, particularly that part of the cover which overlies the cockpit rim and is often struck by the kayak paddle during paddling. The provision of a protective band which is wide enough to protect that portion of a cockpit cover which is highly susceptible to abrasion, yet may deform to fit under a lip, is a problem requiring considerable attention.

Other devices of general interest are shown in U.S. Pat. Nos. 4,031,580 and 1,284,968. Accordingly, an object of the present invention is to provide a spray skirt for covering the cockpit opening of a kayak and the like which has a non-abrading edge band which fits against an underneath lip of the rim of the cockpit and over a portion which overlies a rim of the cockpit.

Another object of the present invention is to provide a spray skirt for covering the cockpit opening of a kayak having a unique elastic retaining edge band which provides a snap action to quickly remove the skirt from the cockpit opening once removal is initiated.

Still another object of the present invention is to provide a spray skirt having an elastic retaining band around the perimeter of the spray skirt having a widened band and a bulbous retention element which enables the band to roll on and off quickly from the lip of the cockpit rim and extends past the rim for abrasion resistance on the outside of the cover.

SUMMARY OF THE INVENTION

The above objectives are accomplished according to the present invention by providing a spray skirt cover constructed of nylon coated neoprene fabric or like material for covering the cockpit opening of a kayak. The spray skirt cover includes an elastic occupant opening for fitting around the waist of a boater. The spray skirt cover includes around its edge a specially designed retaining band for resiliently fitting underneath a lip of the rim of the cockpit. The retaining band includes an outer elastic band which is secured to an exterior cover surface and an inner elastic band secured to an interior cover surface. The outer elastic band and the inner elastic band are joined by an elastic compressible bulbous element which is hollow and has a rounded cross-sectional configuration. The inner elastic band has a sufficient radial extent such that it fits against the lip of the cockpit rim when the cover is fitted about the rim during use. The elastic bulbous element rolls around the rim of the cockpit to fit underneath the lip of the rim and provides tension to maintain the cover in place about the rim. The outer band includes a first outer band extending from the bulbous element upwardly and outwardly terminating at a bend, and a second outer band extending from the band upwardly and inwardly. The first outer band fits under the rim and the second outer band extends over rim and substantially inward over the exterior cover surface to protect the exterior cover surface from abrasion against the rim when hit by the paddle and the like. In a preferred embodiment, the bulbous retention element has a wall thickness greater than a wall thickness of the outer elastic band so that the combination is highly elastic for stretching and full return.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, where in an example of the invention is shown and wherein.

DESCRIPTION OF A PREFERRED EMBODIMENT

Figure 1:
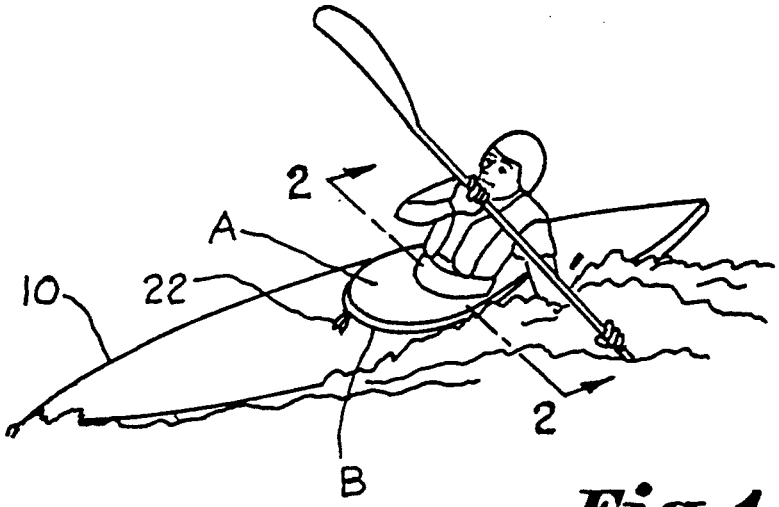
FIG. 1 is a perspective view illustrating a kayak having a spray skirt constructed according to the present invention for covering the kayak cockpit opening and protecting the kayak from entry of water.
Figure 2:
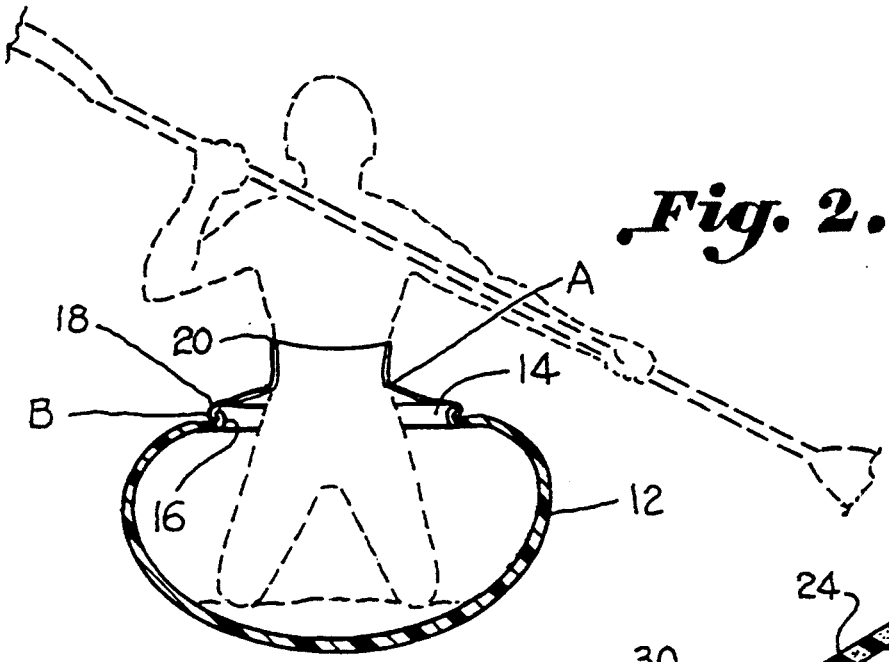
FIG. 2 is a sectional view taken along line 2—2 of FIG. 1.

Referring now in more detail to the drawings, a kayak is illustrated at 10 which includes a rounded exterior hull 12. The boater is illustrated on his knees in FIG. 2; in other types of kayaks the boater is seated. However, in either type of kayak there is a cockpit opening 14 in which the boater either sits or kneels on his knees. The cockpit opening typically includes a raised rim 16 having an outwardly overhanging lip 18 which overhangs a portion of the hull 12.

According to the invention, a spray skirt A is provided for covering the cockpit opening which fits about the waist of the boater to prevent entry of the water into the interior of the hull through the cockpit opening. The spray skirt includes a fitted opening in the form of a waistband 20 which receives and fits about the waist of the boater. A strap handle 22 is provided on the front of the spray skirt. A spray skirt cover 24 spans the cockpit opening 14 when fitted about the rim 16. The spray skirt cover is typically made of a nylon coated neoprene material referred to as fabric herein.

An elastic retaining band B is carried around an outer perimeter of the spray skirt cover. The retaining band includes an outer elastic band 30 secured to an exterior surface 24*a* of the cover and an inner elastic band 32 carried on and secured to an interior surface 24*b* of the spray skirt cover. A compressible bulbous retention element 34 joins the outer and inner bands 30 and 32 in a one-piece strip around the perimeter of the cover. The bulbous retention element 34 is rounded in its cross-section such that it rolls on and off the lip 18 of the rim 16 to facilitate quick removal of the spray skirt cover from the opening as is required in emergency conditions to free the boater. Once the front of the spray skirt cover is pulled upwards by means of the strap 22, the rounded bulbous element 34 comes off of the lip 18 and generally simultaneously therewith the entire retaining element rolls off of the lip around the entire perimeter of the cockpit rim. Being compressible, the bulbous retention element 34 fits good under an underneath surface 18*a* of the lip and compresses to insure a good tight fit as needed underneath the lip and in a notch 36 formed between the rim and the hull of the boat.

The inner elastic band 32 has such an extent toward the center of the spray skirt cover such that it covers the entire underneath surface 18*a* of the lip and extends above the top of the lip 18 to completely protect the fabric of the spray skirt cover against abrading by the hard material of the rim and lip 18. The bands may be secured by any suitable adhesive.

Figure 3:
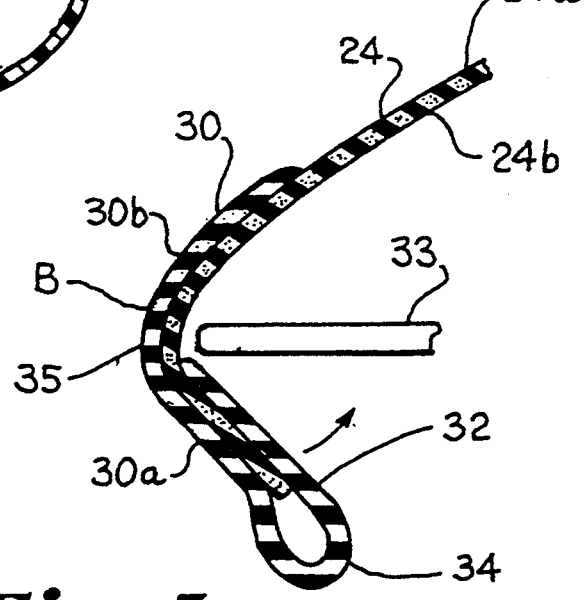
FIG. 3 is an enlarged sectional view of a preformed retaining band having a widened outer band and bend for retaining a spray skirt fitted about the rim of a kayak cockpit opening according to the present invention.

Retaining band B may be preformed in the shape, generally as shown in FIG. 3 by applying adhesive to the retaining band and adhering it to the fabric of cover 24. Pressure is then applied on the lower part of retaining band B as it is bent upward and inward. This forces inner band 32 in the direction of the arrow in Figure 3. For example, inner band 32 may be forced against a form 33 such as plywood and the like by which pressure is applied on the lower part of band B to provide a bend at 35. For these purposes, weight 33*a* may be applied to form 33 to exert pressure downwardly with the inner band 32 folded under the form. The preformed retaining band, thus cups around rim 16 of the cockpit opening when installed in place. The cupping of the preformed retaining band keeps the retaining band in place about the cockpit rim.

Figure 4:
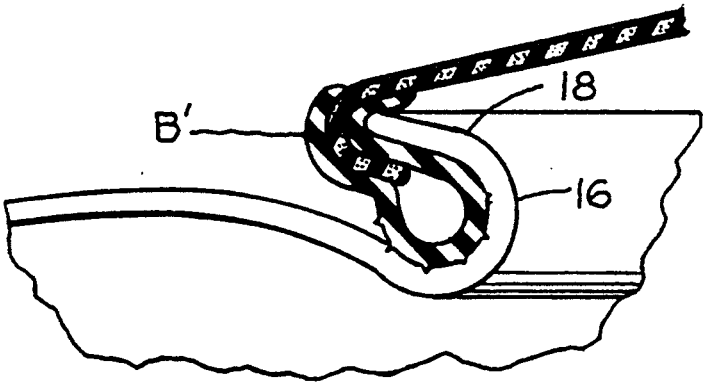
Fig. 4. PRIOR ART
FIG. 4 is a sectional view illustrating a prior art spray skirt and elastic retaining band.

As illustrated in FIG. 4, the prior art has contemplated the use of a flat elastic retaining band 26 on the exterior surface of the spray skirt cover 24 thus leaving the interior surface of the spray skirt cover unprotected against abrasion by the lip. Furthermore, the flat elastic band 26 does not provide for quick removal from the lip since it is twisted and tends to stay against the underneath surface of the lip upon initial removal of the band. There is no rolling off action provided as in the case of the present invention.

Figure 5:
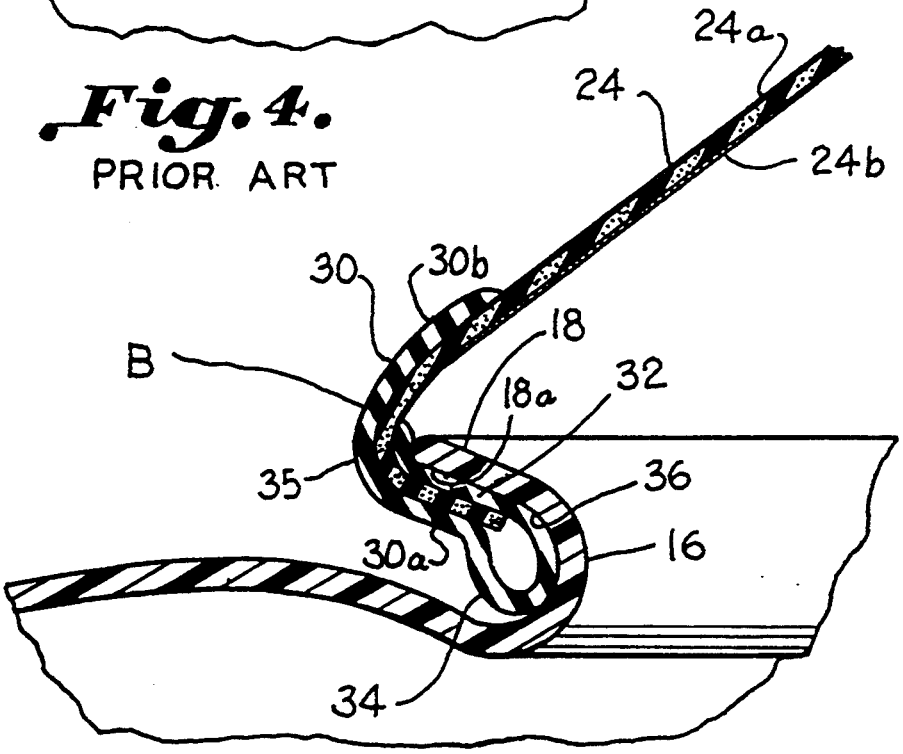
FIG. 5 is an enlarged sectional view illustrating the retaining band constructed according to the present invention retaining the spray skirt fitted about the rim opening of a cockpit.
Figure 6:
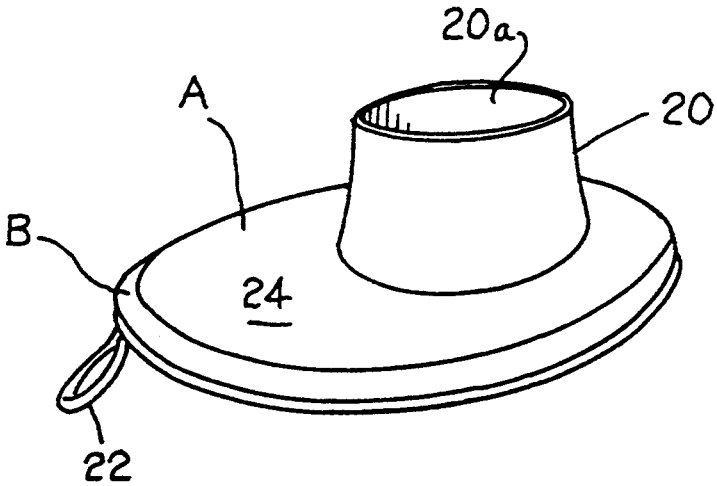
FIG. 6 is a perspective view of a spray skirt and preformed retaining band according to the invention.
Figure 7:
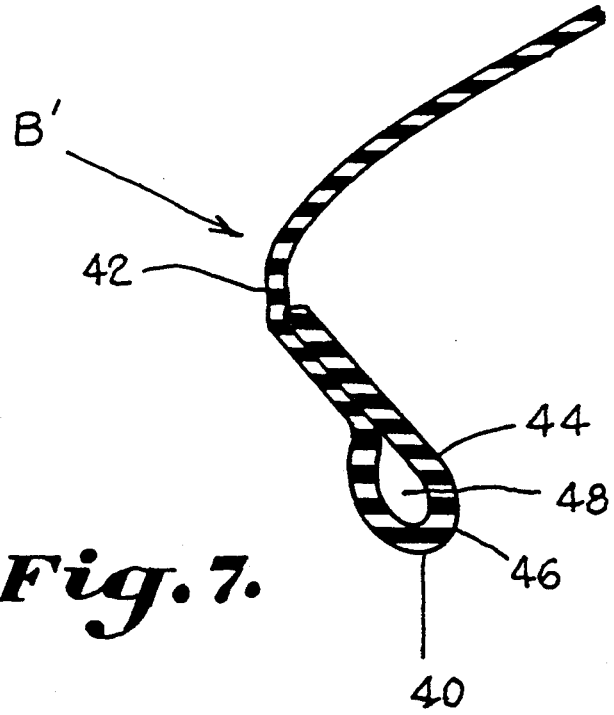
FIG. 7 is an enlarged sectional view of a preferred embodiment of a retaining band having a widened outer elastic band, and a bulbous retention element with a wall thickness that is thicker than the wall of the outer elastic band for increased elasticity facilitating fitting and removal of a spray skirt about the rim lip of a kayak cockpit according to the invention.
Figure 8:
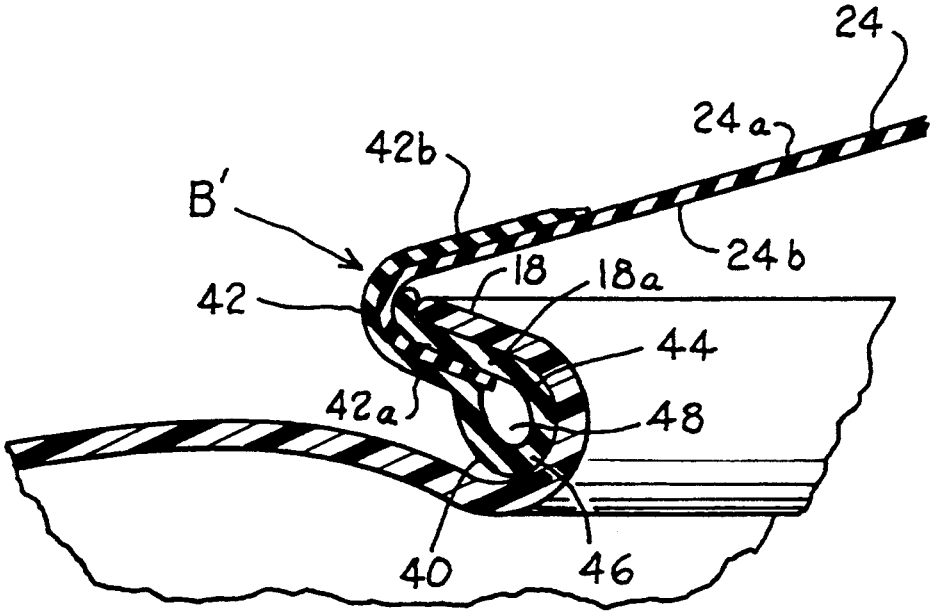
FIG. 8 is an enlarged sectional view illustrating the preferred embodiment of a retaining band according to the invention as fitted about the rim of a kayak cockpit.

As can best be seen in FIGS. 7 and 8, a preferred embodiment of the invention is illustrated wherein an elastic retaining band B′ is illustrated carried around at least a portion of the perimeter of the cover 24. Elastic retaining band B′ includes a bulbous retention element 40 which fits against an underneath surface 18*a* of rim lip 18 for retaining the elastic band in place. An outer elastic band 42 is integral with bulbous retention element 40 and is carried by exterior surface 24*a* of the cover such as by a chemical or adhesive bond. Outer elastic band 42 includes a first band portion 42*a* underlying rim lip 18, a second band portion 42*b* for overlying and extending radially and past a top surface of rim 18. Outer elastic band 42 terminates at a free end which extends substantially past the top surface of the rim to provide abrasion resistance for the cover against the top surface of the rim. An inner elastic band 44 is integral with bulbous retention element 40 and is carried by an interior surface of the cover for contacting the underneath surface 18*a* of the rim lip of the cockpit rim. As can best be seen in FIG. 3, a preferred embodiment of the bulbous retention element 40 includes a bulbous wall 46 which defines a hollow interior 48 which facilitates fitting and removal of cover 24. The bulbous wall has a cross sectional thickness greater than a cross sectional fitness of the outer elastic band 42. It has been found that if the cross sectional thickness of the bulbous wall element is greater than that of the outer band, than the resulting combination produces high stretchability. The combined outer band and bulbous element have a higher elasticity to stretch. The retaining bands stretches and returns fully to the original unstretched shape, and fits tightly underneath the rim when the outerband is thinner. The embodiment of FIGS. 3 and 5 has been found to have a somewhat limited stretchability compared to that of the preferred embodiment so that the degree of reliability of the retention is not quite as high as that of the preferred embodiment. Preferably, the cross sectional thickness of the bulbous wall 46 is about twice the cross sectional thickness of outer band 42. For example, the thickness of the bulbous wall may lie in a range of about 0.1 to 0.2 inches and in one embodiment, bulbous wall 42 had a thickness of 0.125 inches, and the outer elastic band had a thickness of about 0.06 inches. For this purpose, it has been found that a rubber compound of about 50 durometer in the combination of wall thicknesses described above provides a high degree of stretchability, tensile strength, and elongation facilitating tight retention yet easy release and removal of the spray cover.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein described.

What is claimed is:

1. A spray skirt for covering a cockpit opening of a kayak having a raised rim around the perimeter of the opening with an outwardly extending rim lip overhanging the hull of said kayak, said spray skirt comprising:

a spray skirt cover for spanning the cockpit opening and preventing the entry of water into said opening, said cover having an exterior cover surface and an interior cover surface;

a fitted opening formed in said cover for fitting around the waist of a boater;

an elastic retaining band carried around at least a portion of a perimeter of said cover, said elastic retaining band including:

a bulbous retention element which fits against an underneath surface of said rim lip for retaining said elastic retaining band in place;

an outer elastic band integral with said bulbous retention element, said outer elastic band carried by said exterior surface of said cover having a first band portion for underlying said rim lip, a second band portion for overlying and extending past a top surface of said rim, and said outer band terminating at a free end extending substantially past said top surface of said rim to provide abrasion resistance for said cover against said top surface of said rim; and an inner elastic band integral with said bulbous retention element carried about an interior surface of said cover for contacting said underneath surface of said lip of said cockpit rim; and said elastic retaining band being stretchable to facilitate placement over said rim of said cockpit and fitting of said bulbous retention element underneath said rim lip; and wherein the bulbous wall of said bulbous retention element has a cross-sectional thickness greater then a cross-sectional thickness of said outer elastic band.

2. The device of claim 1 wherein said bulbous retention element includes a bulbous wall defining a hollow interior facilitating fitting and removal of said cover.

3. The spray skirt of claim 1 wherein said elastic retaining band is preformed to define a generally set cross-section defined by said second band portion of said outer band and said first band portion of said outer band joining together at a bend where said first and second band portions are angularly disposed.

4. The device of claim 1 wherein said cross-sectional thickness of said bulbous wall is about twice the cross-sectional thickness of said outer band.

5. The device of claim 1 wherein said cross-sectional thickness of said bulbous wall is in a range of 0.1 to 0.2 inches.

6. The device of claim 1 wherein said cross-sectional thickness of said bulbous wall is about 0.125 inches, and said cross-sectional thickness of said outer elastic band is about 0.06 inches.

7. The device of claim 1 wherein said inner elastic band has a sufficient inward extent toward said fitted opening for engaging said underneath surface of said rim lip to prevent abrading of said interior surface of said cover against said rim when said spray skirt cover is attached to said opening.

8. The device of claim 1 wherein said outer elastic band, said bulbous retention element, and said inner elastic band are one piece.

9. A spray skirt for covering a cockpit opening of a kayak having a raised rim around the perimeter of the opening with an outwardly extending rim lip overhanging the hull of said kayak, said spray skirt comprising:

a spray skirt cover for spanning the cockpit opening and preventing the entry of water into said opening, said cover having an exterior cover surface and an interior cover surface;

a fitted opening formed in said cover for fitting around the waist of a boater;

an elastic retaining band carried around at least a portion of a perimeter of said cover, said elastic retaining band including:

a bulbous retention element which fits against an underneath surface of said rim lip for retaining said elastic retaining band in place;

an outer elastic band integral with said bulbous retention element, said outer elastic band carried by said exterior surface of said cover having a first band portion for underlying said rim lip, a second band portion for overlying and extending past a top surface of said rim, and said outer band terminating at a free end extending substantially past said top surface of said rim to provide abrasion resistance for said cover against said top surface of said rim; and an inner elastic band integral with said bulbous retention element carried about an interior surface of said cover for contacting said underneath surface of said lip of said cockpit rim; and said elastic retaining band being stretchable to facilitate placement over said rim of said cockpit and fitting of said bulbous retention element underneath said rim lip; and wherein said inner elastic band terminates near said top surface of said rim lip to prevent abrasion of said interior surface of said cover.

10. A spray skirt for protecting the cockpit seat opening of a kayak from the entry of water, said cockpit opening being of the type having a raised rim surrounding the opening with an outwardly extending rim lip overhanging the hull of said kayak, said spray skirt comprising:

a spray skirt cover for spanning said cockpit opening and preventing entry of water through said opening;

a fitted opening for receiving and fitting about the waist of the boater;

said spray skirt cover having an outer exterior surface and a inner interior surface when fitted over said cockpit opening;

an elastic retaining band which includes at least an outer band secured to said spray skirt cover about a perimeter of said cover which cups around said cockpit rim; and a compressible bulbous retention element formed as part of said retaining band, said bulbous retention element including a hollow interior defined by a surrounding bulbous wall, and said bulbous wall having a cross-section thickness greater than a cross-sectional thickness of said outer band for enabling said retaining band to stretch and snap over said rim and be elastically retained underneath said rim lip of said cockpit rim facilitating quick attachment of said spray skirt cover.

11. The device of claim 10 wherein said cross-sectional thickness of said bulbous wall is about twice the cross-sectional thickness of said outer band.

12. The device of claim 11 wherein said cross-sectional thickness of said bulbous wall is in a range of 0.1 to 0.2 inches.

13. The device of claim 12 wherein said cross-sectional thickness of said bulbous wall is about 0.125 inches, and said cross-sectional thickness of said outer elastic band is about 0.06 inches.

14. The device of claim 10 wherein said bulbous retention element is generally rounded and compressible for rolling and snapping off said rim for quick release thereof.

15. The device of claim 10 wherein said outer band extends from said bulbous retention element upward and inward over at op surface of said rim lip for protecting said exterior surface of said skirt cover from abrasion against said rim.

16. The spray skirt of claim 10 wherein said outer band includes a first band portion and a second band portion; and said elastic retaining band is preformed to define a generally set cross-section defined by said second band portion of said outer band and said first band portion of said outer band joining together at a bend where said first and second band portions are angularly disposed.

* * * * *